US005475354A

United States Patent [19]

Valentian et al.

[11] Patent Number: 5,475,354

[45] Date of Patent: Dec. 12, 1995

[54] PLASMA ACCELERATOR OF SHORT LENGTH WITH CLOSED ELECTRON DRIFT

[75] Inventors: Dominique Valentian, Rosny, France; Alexei Morozov; Antonina Bougrova, both of Moscou, Russian Federation

[73] Assignee: Societe Europeenne de Propulsion, Suresnes, France

[21] Appl. No.: 387,727

[22] PCT Filed: Jun. 21, 1993

[86] PCT No.: PCT/FR93/00612

§ 371 Date: Feb. 16, 1995

§ 102(e) Date: Feb. 16, 1995

[87] PCT Pub. No.: WO95/00758

PCT Pub. Date: Jan. 5, 1995

[51] Int. Cl.[6] ..... H01J 1/52; F03H 1/00; H05H 1/00

[52] U.S. Cl. ..... 335/296; 60/202; 313/359.1; 313/361.1; 313/362.1; 315/111.21; 315/111.41; 315/111.81

[58] Field of Search ..... 60/202; 335/296; 313/359.1, 360.1, 361.1, 362.1, 363.1, 231.31, 231.41, 231.51, 313, 161; 315/111.41, 111.61, 111.51, 111.21, 111.81, 111.91

[56] References Cited

U.S. PATENT DOCUMENTS 5,218,271 6/1993 Egorov et al. ..... 315/111.61
5,359,258 10/1994 Arkhipov et al. ..... 313/359.1

FOREIGN PATENT DOCUMENTS 0541309 5/1993 European Pat. Off. .

OTHER PUBLICATIONS

"Open Single–Lens Hall–Current Accelerator", V. N. Dem'yanenko, et al., vol. 21, No. 8, Aug. 1976, New York, pp. 987–988, Soviet Physics Technical Physics.

"Local Plasma Properties in a Hall–Current Accelerator with an Extended Acceleration Zone", A. M. Bishaev, et al, vol. 23, No. 9, Sep. 1978, New York, pp. 1055–1057, Soviet Physics Technical Physics.

*Primary Examiner*—Leo P. Picard
*Assistant Examiner*—Raymond M. Barrera
*Attorney, Agent, or Firm*—Weingarten, Schurgin, Gagnebin & Hayes

[57] ABSTRACT

The system (31 to 33, 34 to 38) for generating a magnetic field in the main channel of the plasma accelerator are adapted to produce, in the main channel (24) an essentially radial magnetic field at the downstream end (225) of the channel (24), its induction being maximum at this point. The magnetic field has a minimum induction in the transition area in the vicinity of the anode (25), the absolute induction value of the field increasing again upstream of the anode (25), in the region of the buffer chamber (23) in order to produce a magnetic mirror effect. The magnetic field lines include, between the anode (25) and the downstream end (225) of the channel (24), a concavity oriented downstream, causing focusing of ions, the maximum ionisation density area being located downstream of the anode (25). The magnetic field sources comprise several distinct magnetic field sources (31 to 33) and inner (35) and outer (34) radial, plane pole pieces (34, 35) disposed at the outlet face on either side of the main channel (24) and linked to one another by a central core (38), a yoke (36) and a peripheral magnetic circuit (37) axially disposed outside of the main channel (24). The yoke (36) consists of radial elements located in the immediate vicinity of the anode (25) and passing through the annular buffer chamber (23), thereby creating spaces (13) for communication between the annular buffer chamber (23) and the main channel (24).

20 Claims, 8 Drawing Sheets

PLASMA ACCELERATOR OF SHORT LENGTH WITH CLOSED ELECTRON DRIFT

FIELD OF THE INVENTION

The present invention relates to plasma accelerators applied in particular to space propulsion and more particularly it relates to plasma accelerators of the closed electron drift type also referred to as stationary plasma accelerators or, in the USA, as "Hall current accelerators".

PRIOR ART

Electrical accelerators are intended essentially for space propulsion applications. As sources of ions or of plasma, they are also used for terrestrial applications, in particular for ion machining. Because of their high specific impulse (1500 s to 6000 s) they enable considerable mass savings to be achieved on satellites compared with accelerators that make use of chemical propulsion.

One of the typical applications of accelerators of this type is north-south control of geostationary satellites, where a mass saving of 10% to 15% can be achieved. They may also be used for drag compensation in low orbit, for maintaining a heliosynchronous orbit, and for primary interplanetary propulsion.

Ion thrusters can be divided into several categories.

A first type of ion thruster, also known as a Kaufman accelerator, is thus constituted by an accelerator in which ionization is performed by bombardment. Examples of thrusters of that type are described in particular in Documents EP-A-0 132 065, WO 89/05404 and EP-A-0 468 706.

In an accelerator making use of ionization by bombardment, atoms of propellant gas are injected under low pressure into a discharge chamber where they are bombarded by electrons emitted by a hollow cathode and collected by an anode. The ionization process is increased by the presence of a magnetic field. A certain number of atom-electron collisions cause a plasma to be created whose ions are attracted by the acceleration electrodes (outlet grids) themselves at a negative potential relative to the potential of the plasma. The electrodes concentrate and accelerate the ions which leave the thruster in the form of widely spreading radiation. The ion radiation is then neutralized by a flow of electrons emitted from an external hollow cathode, referred to as a "neutralizer".

The specific impulse (Isp) obtained from a thruster of that type can be of the order of 3000 seconds or more.

The power requirement is of the order of 30 W per mN of thrust.

Other types of ionization accelerator are constituted by accelerators using radiofrequency ionization, accelerators using ionization by contact, or field emission accelerators.

Those various ionization accelerators, including accelerators where ionization is obtained by bombardment, have in common the fact that the functions of ionization and of accelerating the ions are clearly separate.

They also have in common the fact of presenting a current density in the ion optics which is limited by the space charge phenomenon, with density being limited in practice to 2 $mA/cm^2$ to 3 $mA/cm^2$ in accelerators where ionization is obtained by bombardment, thus presenting thrust per unit area that is quite low.

In addition, such accelerators, and bombardment accelerators in particular, require a certain number of electrical feeds (between 4 and 10), thereby leading to the implementation of rather complex electronic circuits for conversion and control.

A 1974 article by L. H. ARTSIMOVITCH et al. on the stationary plasma engine (SPD) development program and on tests performed using the "METEOR" satellite, discloses accelerators of the closed electron drift type, also known as stationary plasma accelerators which differ from the other categories of accelerators by the fact that ionization and acceleration are not separate and the acceleration zone includes the same number of ions and of electrons, thereby making it possible to eliminate any space charge phenomenon.

A closed electron drift accelerator as proposed in the above article by L. H. ARTSIMOVITCH et al. is described below with reference to FIG. 2.

An annular channel 1 defined by a part 2 made of insulating material is placed in an electromagnet comprising outer and inner annular pole pieces 3 and 4 respectively placed outside and inside the part 2 of insulating material, a magnetic yoke 12 disposed upstream from the accelerator, and electromagnetic coils 11 that extend over the entire length of the channel 1 and that are connected in series around magnetic cores 10 connecting the outer pole piece 3 to the yoke 12. A grounded hollow cathode 7 is coupled to a xenon feed device to form a cloud of plasma in front of the downstream outlet of the channel 1. An annular anode 5 connected to the positive pole of an electric power supply, e.g. at 300 volts, is disposed in the closed upstream portion of the annular channel 1. A xenon injection tube 6 cooperating with a thermal and electrical insulator 8 opens out into an annular distribution channel 9 disposed in the immediate vicinity of the annular anode 5.

Ionization and neutralization electrons come from the hollow cathode 7. The ionization electrons are attracted in the insulating annular channel 1 by the electric field that extends between the anode 5 and the cloud of plasma coming from the cathode 7.

Under the effect of the electric field E and of the magnetic field B created by the coils 11, the ionization electrons follow an azimuth drift trajectory as required for maintaining the electric field in the channel.

The ionization electrons then drift around closed trajectories inside the insulating channel, whence the name of the accelerator.

The drift motion of the electrons considerably increases the probability of collisions between the electrons and neutral atoms, where collision is the phenomenon that produces the ions (in this case of xenon).

The specific impulse obtained by conventional ion accelerators with closed electron drift operating on xenon is of the order of 1000 seconds to 2500 seconds.

In conventional ion accelerators with closed electron drift, the ionization zone is not organized, and as a result they operate well only with xenon, the jet is divergent (beam spread over an angle of ±20°), and efficiency is limited to about 50%.

In addition, the divergence of the jet causes the wall of the insulating channel to wear, which channel is normally made of a mixture of alumina and boron nitride.

The lifetime of such an engine is about 3000 h.

It has been further proposed, in particular in an article entitled "Open single-lens Hall-current accelerator" by V. N. Dem'Yanenko, L. P. Zudkov and A. I. Morozov, published in August 1976 in the journal "Soviet Physics Technical Physics", Vol. 21 No. 8 pp. 987–988 that the two functions of the anode be separated by using on the one hand a cylindrical anode and, on the other hand, an annular gas distributor. Such an embodiment enables the ionizable gas flow to be uniformly distributed near the anode. The anode and the annular gas distributor are separated by a buffer chamber to enable a homogenization. However, the plasma accelerator disclosed in the above-mentioned article operates in a pulsed mode with a high discharging voltage and is generally not well suited for space propulsion applications.

Object and brief summary of the invention

An object of the invention is to remedy the drawbacks of known plasma accelerators, and more particularly to modify plasma accelerators with closed electron drift so as to improve their technical characteristics, and in particular to enable the ionization zone to be better organized but without thereby creating a space charge as happens in ions accelerators using bombardment, for example.

The invention also seeks to reduce the divergence of the jet and to increase the density of the ion jet, its electrical efficiency, specific impulse, and lifetime.

Another objet of the invention is to reduce the mass and the size of the engine.

These objects are achieved by a plasma accelerator of short length with closed electron drift, the accelerator comprising a main annular channel for ionization and acceleration delimited by parts of insulating material and open at its downstream end, at least one hollow cathode disposed outside the main annular channel adjacent to the downstream portion thereof, an annular anode concentric with the main annular channel and disposed at a distance from the open downstream end thereof, first and second means for feeding ionizable gas and respectively associated with the hollow cathode and with the annular anode, magnetic means for creating a magnetic field in the main annular channel and an annular buffer chamber whose size in the radial direction is at least equal to that of the main annular channel and which extends upstream therefrom beyond the zone in which the annular anode is placed, the second means for feeding an ionizable gas opening out in the annular buffer chamber upstream from the anode into a zone that is distinct from the zone including the anode, characterized in that the means for creating a magnetic field in the main channel are adapted to produce a magnetic field in said main channel that is essentially radial at the downstream end of the channel and has a maximum induction at this level, this magnetic field having a minimum induction in the transition zone situated in the vicinity of the anode, the absolute value of the induction of this magnetic field increasing again upstream from the anode, at the level of the buffer chamber to produce a magnetic mirror effect, the magnetic field lines having, between the anode and the downstream end of the channel, a concavity which is orientated downwards and produces a focussing of the ions, a region located downstream from the anode having a maximum ionisation density, in that the means for creating a magnetic field comprise a plurality of distinct magnetic field creation means and inner and outer plane radial pole pieces disposed level with the outlet face on either side of the main channel and interconnected by a central core, a yoke, and a peripheral magnetic circuit disposed axially outside the main channel, the yoke being made up of radial elements situated in the immediate vicinity of the anode and penetrating into the annular buffer chamber, communication spaces between the annular buffer chamber and the main channel being left between the radial elements.

Advantageously, the dimension of the buffer chamber in the radial direction is comprised between one and twice the radial dimension of the main channel.

More particularly, the distinct magnetic field creation means comprise first means disposed around and outside the main channel in the vicinity of the downstream end thereof, second means disposed around the central core in a zone facing the anode and extending in part over the buffer chamber for the creation of the magnetic mirror effect, and third means disposed around the central core between the second means and the downstream end of the main channel.

In one possible embodiment, the first, second, and third magnetic field creation means are constituted by induction coils.

In particular because of the physical separation of the anode and the ionizable gas manifold, because of the existence of a buffer chamber, and because a magnetic field is established having a particular profile, the plasma accelerator of the invention presents the following set of advantages:

a) ionization is more effective, giving rise to greater efficiency;

b) it is easy to ionize various thrust gases such as xenon, argon, etc. because of an improvement in the ionization process;

c) electrostatic equipotentials are obtained that reduce the divergence of the beam, whence:

c1) easier integration in a satellite; and c2) reduced wear of the acceleration channel.

More specifically, due to the provision of a particular magnetic field profile within the acceleration channel upstream from the anode and in the midst of the buffer chamber:

the homogeneity of the plasma is improved and the distorsion of electrostatic equipotential lines is thus reduced in the acceleration zone, which contributes to limit the ion losses on the walls and to increase the beam focusing, the region in which the ions are produced is better localized, which contributes to reduce the ion energy scattering, and an immaterial plasma confinement is achieved upstream from the anode through a magnetic mirror effect.

The transition between the minimum value of the magnetic field in the vicinity of the anode and the maximum value at the output of the acceleration channel (about 300 Oe) always guarantees that a zone will be obtained where the ionization probability is raised to a maximum.

The geometry of the buffer chamber enables an extension of the plasma upstream from the anode and a retention in place of the plasma due to the magnetic mirror effect.

The fact that, according to the invention, the connecting yoke between the central core and the peripheral magnetic circuit is situated in the immediate vicinity of the anode and penetrates into the annular buffer chamber, makes it possible to reduce the length and thus the mass of the entire magnetic circuit, thereby giving rise to an accelerator whose mass and dimensions are considerably smaller than those of embodiments in which the connection yoke between the central core and the peripheral magnetic circuit is situated upstream from the buffer chamber.

The connection yoke that passes through the buffer chamber while leaving communication spaces with the main channel may be implemented in various different ways.

Thus, the yoke may comprise radial elements constituted by cylindrical magnetic bars passing through the annular chamber.

In which case, the magnetic bars may be constituted by metal bars that are electrically insulated by two-part sheaths which parts are respectively secured to the walls of the main channel and to the walls of the buffer chamber.

In one particular embodiment, the magnetic bars are interconnected at their peripherally outer ends by a continuous magnetic ring constituting a structural part for fixing the accelerator to the structure of a satellite.

The magnetic bars may also be constituted by metal bars that are electrically insulated from ground by ferrite parts respectively constituting said central core and said peripheral magnetic circuit disposed axially outside the main channel, the magnetic bars being capable of being biased to the same potential as the anode.

In another possible embodiment, the magnetic bars are constituted by an insulating ferrite material enabling them to be directly implanted in the buffer chamber.

The peripheral magnetic circuit may comprise a set of link bars between the radially outer pole piece and the yoke, or else it may be constituted by a shell.

The yoke may comprise bars extending radially in a plane substantially perpendicular to the axis of the buffer chamber and of the main channel.

However, in another possible embodiment, the yoke comprises bars extending radially along the generator lines of a truncated cone whose smaller section end is connected to the central core, its larger section end being connected to the peripheral magnetic circuit, and its axis coinciding substantially with the axis of the buffer chamber and of the main channel.

In yet another particular embodiment, the yoke comprises a frustoconical ferrite part whose smaller section end is connected to the central core and whose larger section end is connected to a shell constituting the peripheral magnetic circuit, channels formed axially through said frustoconical part constituting said spaces for communication between the annual buffer chamber and the main channel.

The invention further relates to a plasma accelerator, in which the buffer chamber comprises a plurality of alveoles which open out into the acceleration channel in the vicinity of the anode, are distributed around the axis of the accelerator and are delimited by partitions which are parallel to the axis of the accelerator and define, between adjacent alveoles, passages for cylindrical magnetic bars which constitute the yoke without penetrating into the alveolate buffer chamber.

Such a buffer chamber may be made in one piece.

According to a possible embodiment, the second means for feeding an ionizable gas open out in the annular buffer chamber upstream from the anode through an annular manifold.

In the case of an alveolate buffer chamber, the annular manifold is associated with sonic throats opening out in the different alveoles of the alveolate buffer chamber.

According to another possible embodiment, the second means for feeding an ionizable gas open out in the annular buffer chamber upstream from the anode through a single sonic throat which is mounted tangentially along the largest diameter of the buffer chamber to create a vortex.

When the mean diameter of the accelerator is large with respect to the channel width, according to a particular embodiment, the hollow cathode is located along the axis of the accelerator within the central tubular core and is thermally insulated from this central core through a superinsulating screen.

BRIEF DESCRIPTION OF THE DRAWINGS

Other features and advantages of the invention appear from the following description of particular embodiments, given as non-limiting examples and with reference to the accompanying drawings, in which.

Detailed description of particular embodiments

Figure 1:
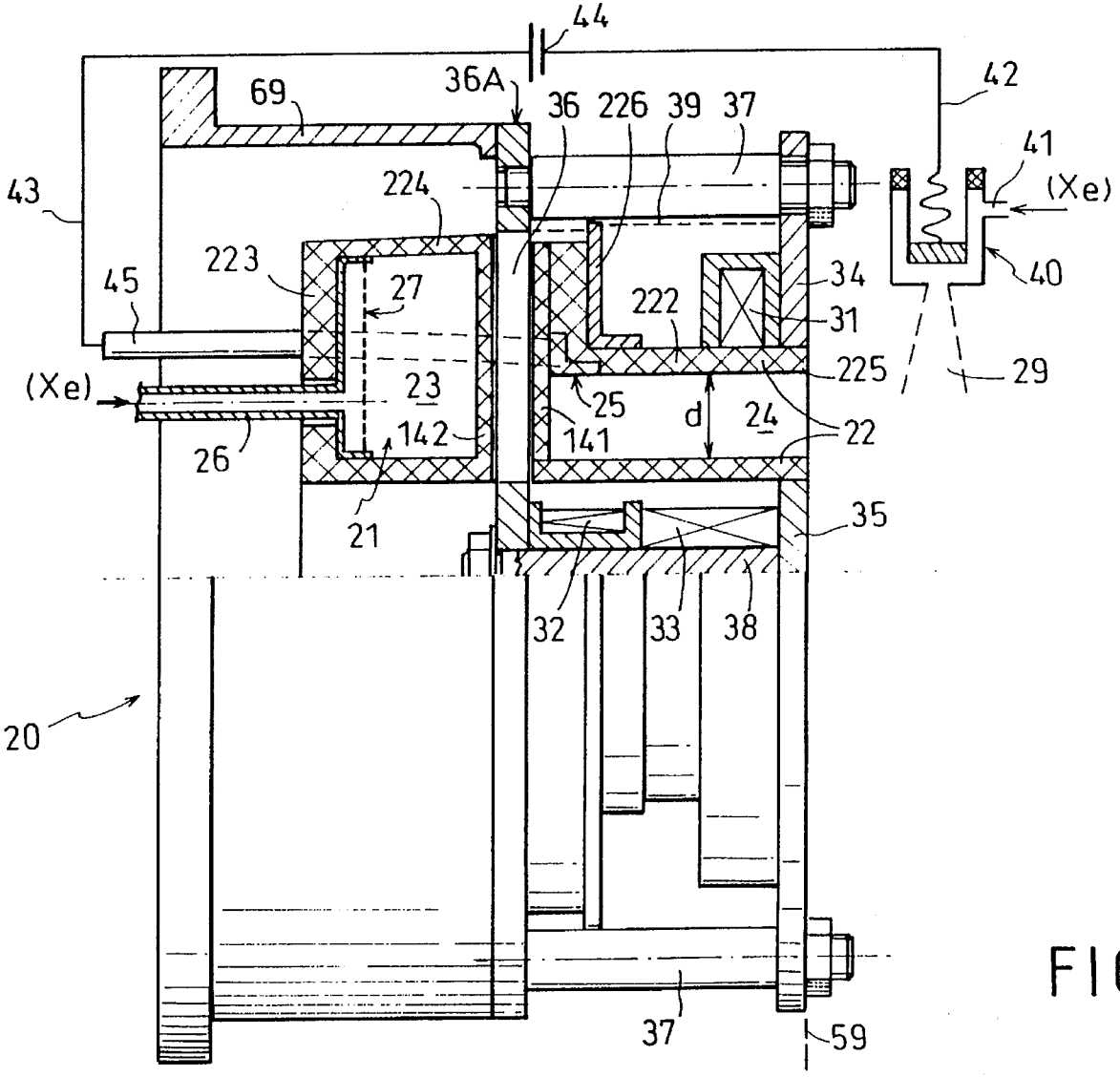
FIG. 1 is an elevation view and an axial half-section view of one example of a plasma accelerator with closed electron drift according to the present invention.
Figure 2:
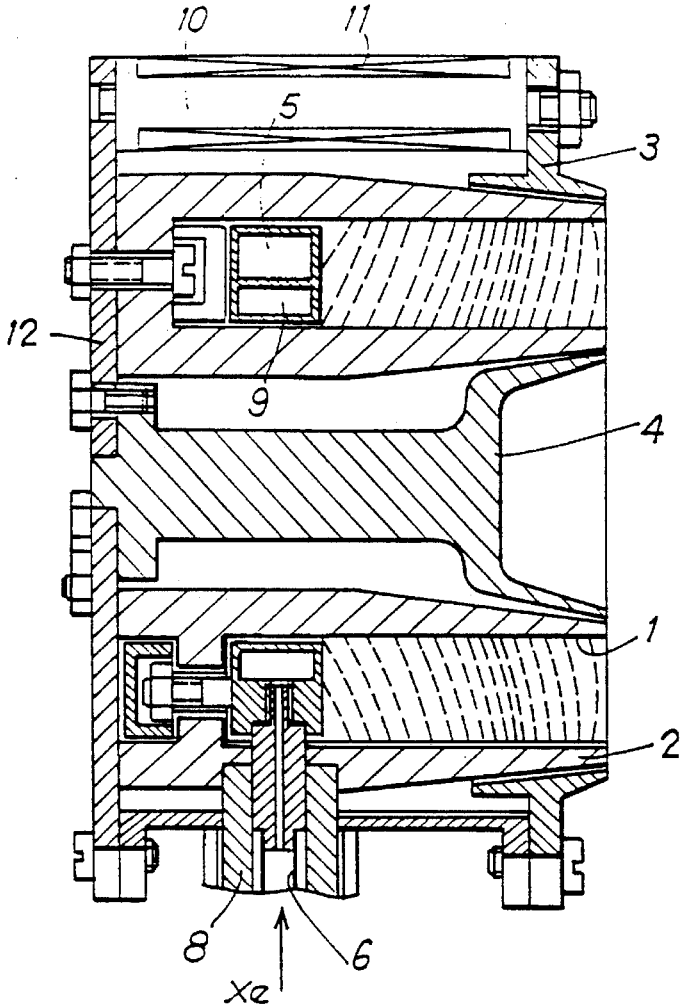
FIG. 2 is an axial section view showing an example of a prior art plasma accelerator with closed electron drift.

FIG. 1 shows an example of a plasma accelerator 20 with closed electron drift according to the invention comprising a set of parts 22 made of insulating material delimiting an annular channel 21 formed at its upstream end by a first portion constituted by a buffer chamber 23 and at its downstream end by a second portion constituted by an acceleration channel 24.

The dimension of the annular chamber 23 in the radial direction is preferably between once and twice the dimension of the annular acceleration channel 24 in the radial direction. In the axial direction, the buffer chamber 23 may be a little shorter than the acceleration channel 24 and advantageously its length is between about one and one-and-a-half times the dimension d in the radial direction of the acceleration channel 24.

An anode 25 is connected by an electrical line 43 to a DC voltage source 44 (which may be at about 200 V to 300 V) and is disposed on the insulating parts 22 delimiting the annular channel 21 in a zone situated immediately downstream from the buffer chamber 23, at the inlet to the acceleration channel 24. The line 43 for powering the anode 25 is disposed in an insulating tube 45 which passes through parts 223 and 224 of insulating material that delimit the buffer chamber 23.

A tube 26 for feeding an ionizable gas such as xenon also passes through the end wall 223 of the buffer chamber 23, opening out into an annular gas manifold 27 placed at the end of the buffer chamber The channel 21 delimited by the set of insulating parts 22 is placed in a magnetic circuit essentially constituted by three coils 31, 32, and 33, and by pole pieces 34 and 35.

Outer and inner plane pole pieces 34 and 35 are placed in the outlet plane of the accelerator outside the acceleration channel 24 and set up magnetic field lines that are substantially parallel to the outlet plane 59 of the accelerator 20 in the downstream open portion of the acceleration channel 24.

The magnetic circuit constituted by the pole pieces 34 and 35 is closed by an axial central core 38 and by link bars 37 disposed at the periphery of the accelerator in an essentially cylindrical configuration, the central core 38 of ferromagnetic material and the link bars 37 of ferromagnetic material coming into contact with a rear link yoke 36 of ferromagnetic material. The yoke 36 is constituted by elements that are essentially radial and which are situated in the immediate vicinity of the anode 25, penetrating into the buffer chamber 23 and leaving between them communication spaces 136 between the buffer chamber 23 and the annular channel 24.

An antipollution or antiradiation screen 39 may also be disposed between the insulating parts 22 and the link bars 37. The link bars 37 and the screen 39 may nevertheless be replaced by a cylindrical or a cylindroconical shell which acts simultaneously as an antipollution screen and to close the magnetic circuit.

The electrons required for operation of the accelerator are provided by a hollow cathode 40 which may be conventional in design. The cathode 40 which is electrically connected by a line 42 to the negative pole of the voltage source 44 includes a circuit 41 for feeding it with an ionizable gas such as xenon, and it is located downstream from the outlet zone of the acceleration channel 24.

The hollow cathode 40 provides a plasma 29 substantially at the reference potential, with electrons being extracted therefrom and travelling towards the anode 25 under the effect of the electrostatic field E due to the potential difference between the anode 25 and the cathode 40.

These electrons have an azimuth drift trajectory in the acceleration channel 24 under the effect of the electric field E and of the magnetic field B.

Typically, the field at the outlet from the channel 24 is 150 Oe to 200 Oe.

The primary electrons are accelerated by the electrostatic field E, and they thus strike the wall of the insulator 22 which provides secondary electrons of lower energy.

The electrons come into collision with the neutral atoms of xenon from the buffer chamber 23.

The xenon ions formed in this way are accelerated by the electrostatic field E in the acceleration channel 24.

There is no space charge in the acceleration channel 24 because of the presence of the electrons.

The ion beam is neutralized by a fraction of the electrons coming from the hollow cathode 40.

The control obtained over the gradient of the radial magnetic field because of the disposition of the coils 31 to 33 and of the pole pieces 34 and 35 makes it possible to separate the function of accelerating the ions from the ionization function obtained in a zone close to the anode 25. This ionization zone may extend partially into the buffer chamber 23.

An important feature of the accelerator of the invention lies in the existence of a buffer chamber 23 which makes it possible to optimize the ionization zone.

In conventional accelerators with closed electron drift0, a considerable fraction of ionization takes place in the middle portion. Some of the ions strike the walls and this is a cause of rapid wall wear, thereby reducing the lifetime of the thruster. The buffer chamber 23 helps reduce the radial gradient of plasma concentration and also helps reduce the cooling of electrons at the inlet to the acceleration channel 24, thereby reducing the divergence of the ion beam against the walls, and thus avoiding the loss of ions by collision with the walls, thereby having the effect of increasing efficiency and of reducing the divergence of the beam at the outlet from the accelerator.

Another important feature of the motor of the invention lies in the presence of the three coils 31 to 33 which may be of different dimensions and which enable the magnetic field to be optimized by virtue of their specific positioning.

Figure 8:
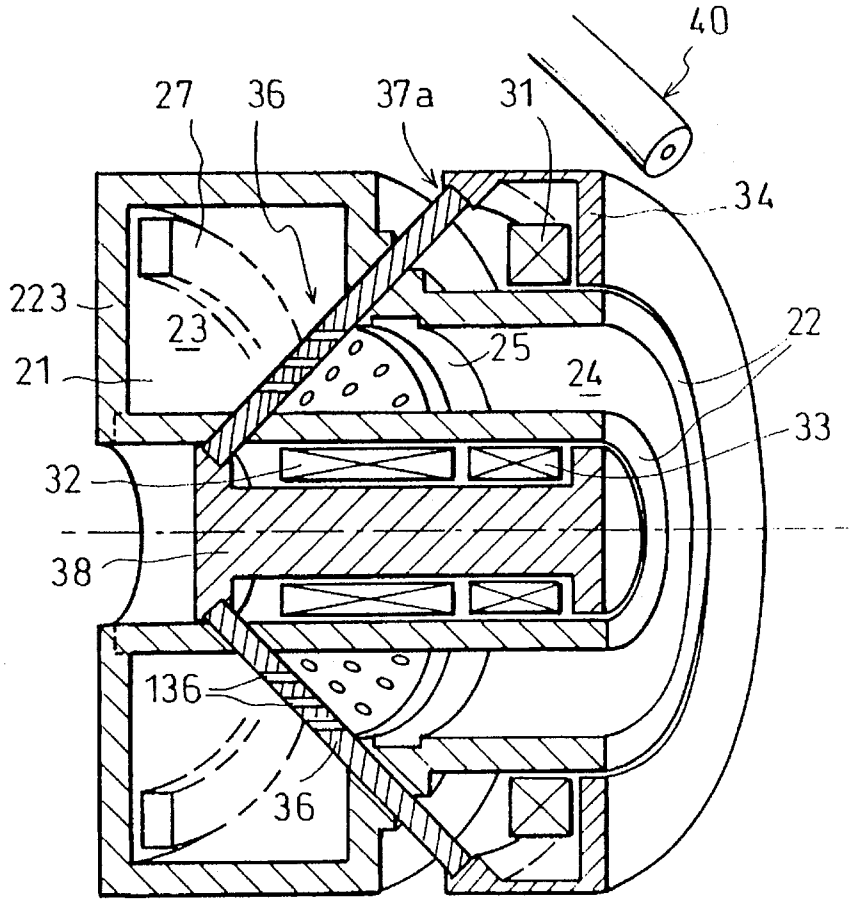
FIG. 8 is an axial section through a particular embodiment of a plasma accelerator of the invention in which the link yoke is constituted by a conical shell pierced by axial link channels.
Figure 7:
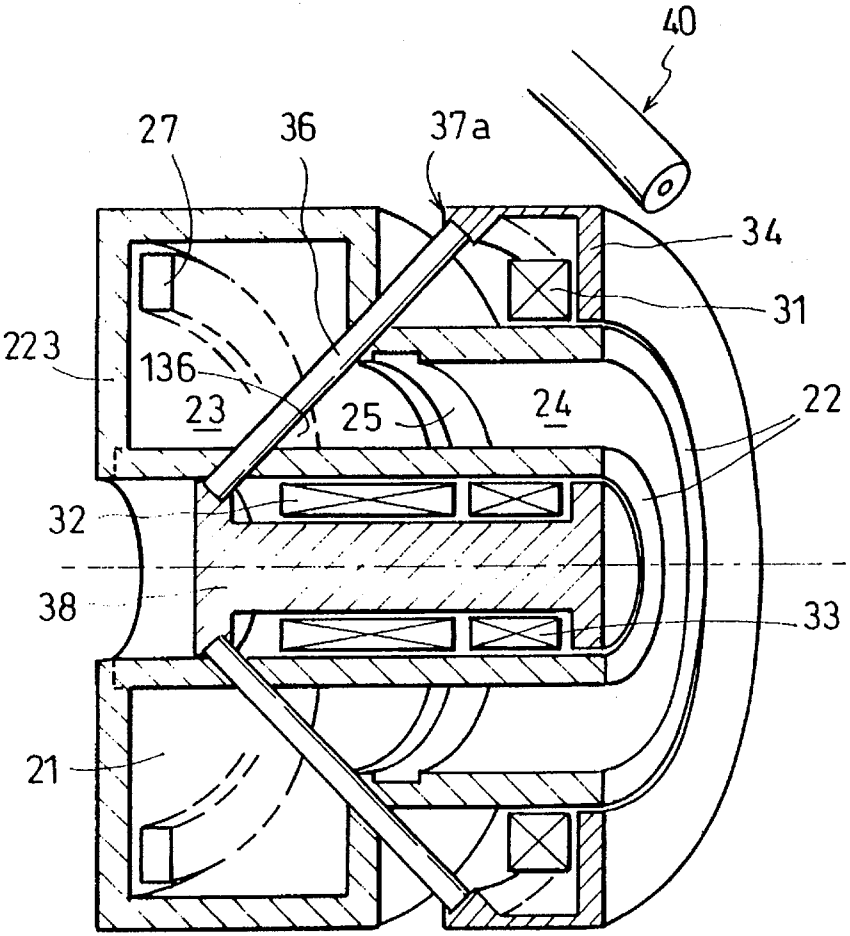
FIG. 7 is an axial section through a particular embodiment of a plasma accelerator of the invention in which the link yoke is constituted by bars disposed in a cone.

Thus, a first coil 31 is disposed around and outside the main channel 24 in the vicinity of the downstream end 225 thereof. A second coil 32 is disposed around the central core 38 in a zone facing the anode 25 and capable of extending partially over the buffer chamber 23 to enable the creation of a magnetic mirror effect (FIGS. 7 and 8). A third coil 33 is disposed around the central core 38 between the second coil 32 and the downstream end 225 of the main acceleration channel 24. The coils 31, 32, and 33 may be of different sizes. The consequence of having three well-differentiated coils 31, 32, and 33 is to create field lines that are better directed, thus making it possible to obtain a jet that is channeled better, and in particular that is more parallel, than in conventional accelerators.

The created magnetic field is essentially radial at the end 225 of the main acceleration channel 24 and has a magnetic induction which is at a maximum at this level. The magnetic field has a minimum value, which may be equal to zero, in the vicinity of the anode. The absolute value of the magnetic field increases again upstream from the anode 25 in particular within the buffer chamber 23. This configuration of the magnetic field creates a magnetic mirror effect which prevents the plasma from propagating into the buffer chamber 23.

In a variant embodiment, the magnetic field coils 31 to 33 may be replaced, at least in part, by permanent magnets having a Curie point higher than the operating temperature of the accelerator.

The annular coil 31 could also be replaced by a set of individual coils disposed around the various different link bars 37 constituting the peripheral magnetic circuit.

The material of the magnetic circuit constituted by the pole pieces 34 and 35, the central core 38, the bars 37, and the yoke 36 may be soft iron, ultrapure iron, or an iron-chromium alloy having high magnetic permeability.

By way of example, the pole pieces 34 and 35 may extend about 20 millimeters in the axial direction.

The number of ampere-turns in each coil 31, 32, 33 and the ratio of the length to the diameter of each coil are determined so as to produce a magnetic field in the acceleration channel that is essentially radial, with the maximum thereof being situated in the outlet plane 59 of the accelerator, with its field lines close to the outlet 225 being essentially parallel to the outlet face 59, and with its field lines in the vicinity of the anode 25 being essentially disposed so as to enhance ionization of the thrust gas in this region.

Examples of ion thrusters of the invention combining the presence of a buffer chamber 23 and of a set of distinct coils 31, 32, and 33 have achieved electrical efficiencies of about 50% to 70%, thus giving an average improvement of about 10% to about 25% over previously known systems.

In addition, the jet obtained at the outlet from embodiments of the invention is practically cylindrical, with very little divergence of the jet of ions, the divergence being about ±9°. Thus, using an acceleration channel having an outside diameter of 80 mm, 90% of the energy remains concentrated in the diameter of the acceleration channel at a distance of 80 mm outside the accelerator relative to its outlet plane 59.

In general, the accelerator of the invention enables a higher thrust density to be obtained (e.g. about 1 $mN/cm^2$ to 2 $mN/cm^2$ thrust density per unit area), thus making it possible to have an accelerator that is smaller and lighter for given thrust, with excellent efficiency being obtained.

As for lifetime, known accelerators have a lifetime of about 3000 h.

In contrast, a plasma accelerator of the present invention makes it possible to obtain a lifetime of at least 5000 hours to 6000 hours because of the reduced erosion of the channel 24 due to the more cylindrical ionized jet.

The plasma accelerator of the invention may be implemented in numerous different ways.

In the example shown in FIG. 1, a magnetic circuit is shown that comprises an outer pole piece 34, an inner pole piece 35, a magnetic core 38, a link yoke 36, and 5 axial ferromagnetic bars 37 which extend to an outer ring 36A that forms a portion of the link yoke 36 and that acts as a structural component suitable for fixing directly to the assembly plate for the accelerator on a satellite, thereby creating a fixing zone that is very close to the center of gravity of the accelerator, thus improving vibration performance, or else, and as shown in FIG. 1, the accelerator is connected to the assembly plate by a non-magnetic cylindrical shell 69 which thus constitutes an assembly interface.

Figure 3:
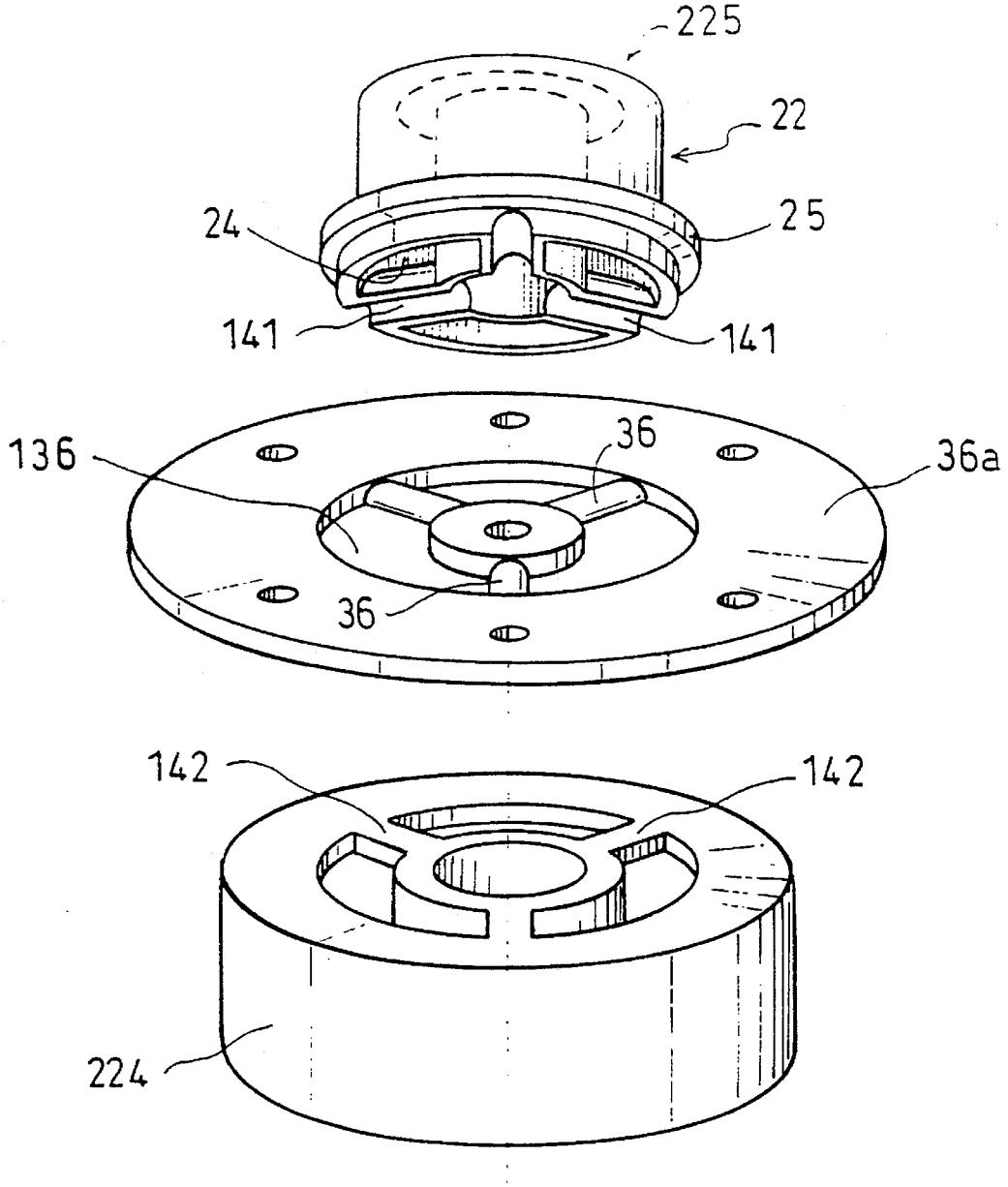
FIG. 3 is an exploded perspective view of a fraction of the component parts of a plasma accelerator of the invention showing a yoke having metal bars that are electrically isolated by two-part sheaths.

The link yoke between the central magnetic core 38 and the axial ferromagnetic bars 37 is constituted by radial bars 36 of ferromagnetic material passing through the buffer chamber 23 just upstream of the main channel 24 and the anode 25, leaving large communication spaces 136 therebetween for communication between the buffer chamber 23 and the main channel 24, as shown more clearly in FIG. 3.

The number of bars 36 may, for example, lie in the range three to nine. The outer ring 36A is in the form of a washer and may be formed integrally with the bars 36.

Figure 3A:
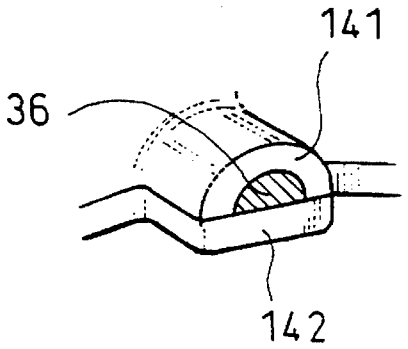
FIG. 3*a* shows a detail of how an insulated bar is implemented in the embodiment of FIG. 3.

In the embodiment of FIGS. 1, 3, and 3A, the bars 36 are shown as being electrically insulated by insulating sheaths 141 and 142. The sheaths 141 and 142 are advantageously made in two portions 141 and 142 secured respectively to the walls 22 of the main channel 24 and to the walls 224 of the buffer chamber 23. More particularly, in the embodiment shown in FIGS. 3 and 3A, the bars 36 are semicylindrical in section, each half-sheath 141 having a section that fits over the semicylindrical shape of a bar 36, while each half-sheath 142 is plane in shape and overlies the plane face of a bar 36.

Figure 4:
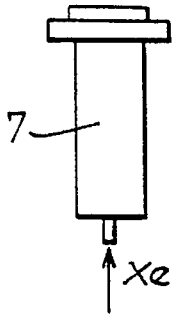
FIG. 4 is an axial half-section view of a plasma accelerator of the invention, similar to that of FIG. 1, but having different link means to the support plate.
Figure 4:
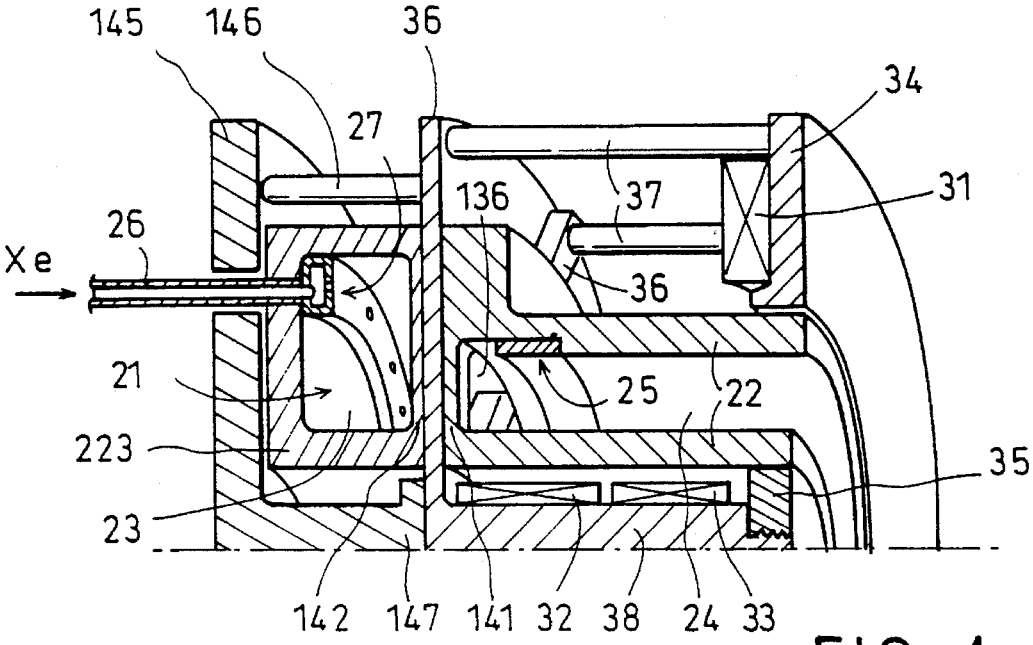

FIG. 4 is an axial half-section and perspective view showing a variant embodiment in which the bars 36 constitute radial arms that are not interconnected by a ring 36A at their outer ends. The various axial bars 37 are then connected directly to the outer ends of the radial bars 36. Each bar 36 is also connected by a spacer 146 to the baseplate 145 for mounting on a satellite. The central core 38 is itself held by an extension 147 of the baseplate 145.

For reasons of clarity, FIG. 3, FIG. 4, and FIGS. 5 to 8 do not show various items shown in FIG. 1, e.g. the electrical feed means for the anode 25.

Figure 5:
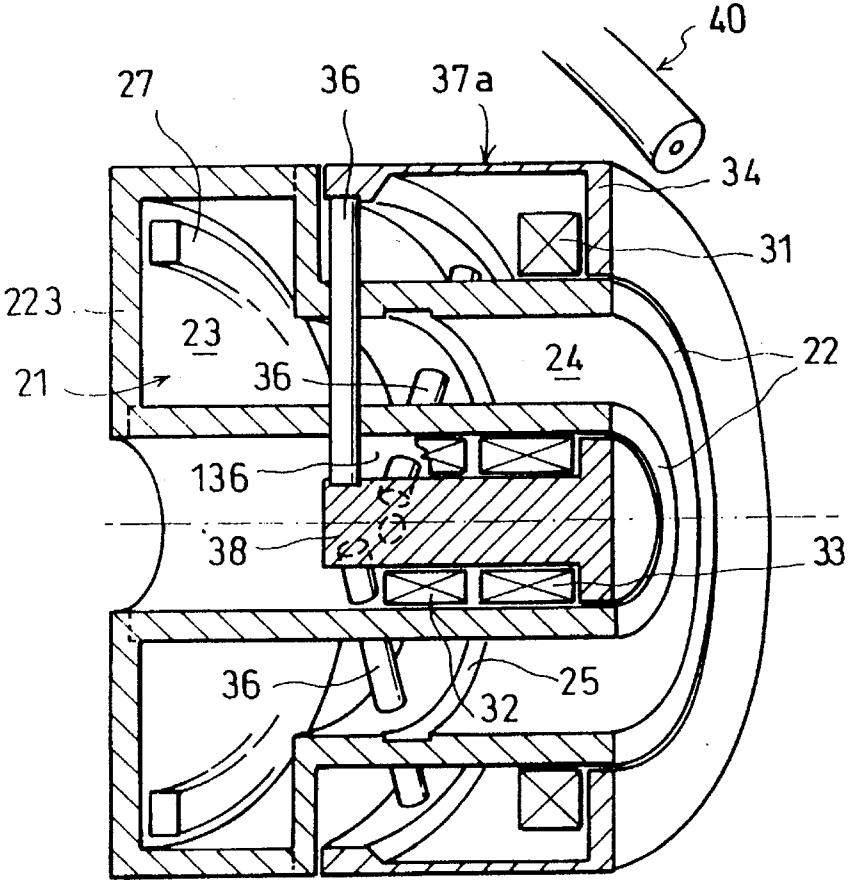
FIG. 5 is an axial section through a variant embodiment of a plasma accelerator of the invention with a yoke having link bars made of ferrite.

In the embodiment of FIG. 5, the axial bars 37 are replaced by an outer shell 37*a* of ferromagnetic material. The radial bars 36 are themselves made of electrically insulating soft ferrite. The bars 36 therefore have no need to be surrounded by insulating sheaths 141 and 142 as in the embodiments of FIGS. 1, 3, and 4. When the bars 36 are made of soft ferrite, the electrostatic field is not disturbed in the vicinity of the bars 36.

Sealing may be obtained between the bars 36 and the insulating ceramic walls 22 of the main channel 24 by using a glass sealant or a cement, providing that the ceramic and the ferrite are selected so as to have coefficients of expansion that are similar.

By way of example, the particular configuration of FIG. 5 has seven radial cylindrical bars 36 made of ferrite closing the magnetic circuit between the outer shell 37*a* and the central core 38.

Figure 6:
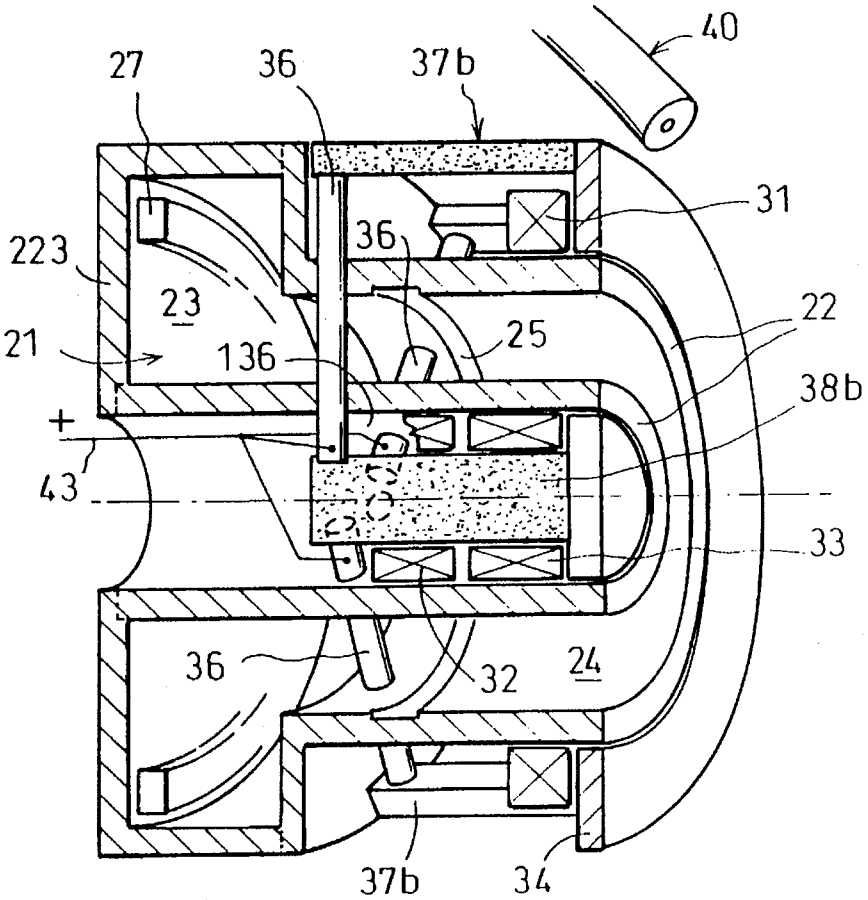
FIG. 6 is an axial section through a variant embodiment of a plasma accelerator of the invention with link bars made of metal and with portions of its magnetic circuit made of ferrite.

In the embodiment of FIG. 6, the link bars 36 are made of a ferromagnetic metal, but they are not surrounded by insulating sheaths. In contrast, the central core 38 and the parts 37*b* constituting the axially outer portion of the magnetic circuit (in the form of bars or in the form of a shell) are made of electrically insulating ferrite.

Under such circumstances, the metal bars 36 may be biased to the same potential as the anode and may act as the anode 25 or as an additional anode.

FIG. 7 shows an embodiment in which the radial link bars 36 are no longer disposed in a plane perpendicular to the axis of the accelerator, but are disposed along the generator lines of a cone whose base is directed towards the downstream end of the accelerator. The base of the cone is thus formed by a shell 37*a* constituting the axially outer portion of the magnetic circuit while the apex of the cone, or the small section of the truncated cone are connected to the central core 38 through the buffer chamber 23. This embodiment makes it possible to implement a long coil 32 in the vicinity of the junction between the buffer chamber 23 and the main channel 24.

FIG. 8 shows an embodiment in which the link yoke 36 is not made up of distinct bars but is constituted by a conical piece of ferrite whose large base is directed towards the downstream end of the accelerator and is connected to the cylindrical shell 37*a* constituting the axially outer portion of the magnetic circuit, while its apex is connected to the central core 38, the conical part 36 passing through the buffer chamber 23 upstream from the anode 25. The buffer chamber 23 is thus subdivided into two cavities which communicate via channels 136 pierced axially through the conical part 36. The number of channels 136 or the section thereof is large enough to present negligible impedance to the flow of gas.

As in the embodiment of FIG. 7, implementing the link yoke 36 in the form of a cone that passes through the buffer chamber 23 upstream from the anode 25 makes it possible to dispose a relatively long coil 32 in the vicinity of the junction between the buffer chamber 23 and the main channel 24.

Figure 9:
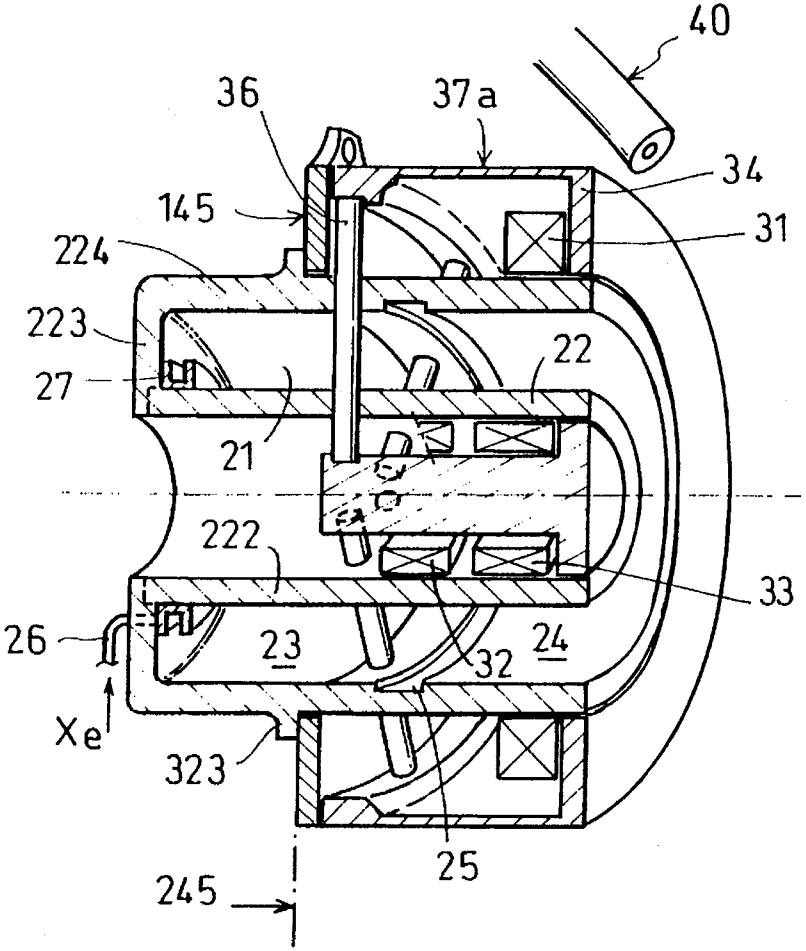
FIG. 9 is an axial section through a particular embodiment of a plasma accelerator of the invention comprising a buffer chamber which constitutes a cylindrical extension of the acceleration channel without any increase of the outer diameter.

FIG. 9 shows a plasma accelerator according to the invention, in which the buffer chamber 23 constitutes a cylindrical extension of the acceleration channel 24. In such a case, the transversal dimension of the buffer chamber 23, and the outer diameter of the latter are the same as for the acceleration channel 24.

The set of pieces 222, 223, 224 defining the annular channel 21 which comprises in a sequence the buffer chamber 23 and the acceleration channel 24 shows on the outer face of its wall 224, perpendicularly to the accelerator axis, a flange 323 for its mounting on an interface flange 145 against which abuts the outer shell 37*a* constituting the axially outer portion of the magnetic circuit. The interface plane where the accelerator may be fixed on the supporting structure of the satellite bears the reference 245.

The structure of the accelerator of FIG. 9 may otherwise be similar for example to the embodiment of FIG. 5. The annular manifold 27 for feeding an ionizable gas may however preferably be located near the bottom 223 of the buffer chamber 23 in the vicinity of the inner piece 222 which both delimits the buffer chamber 23 and the acceleration channel 24.

Figure 11:
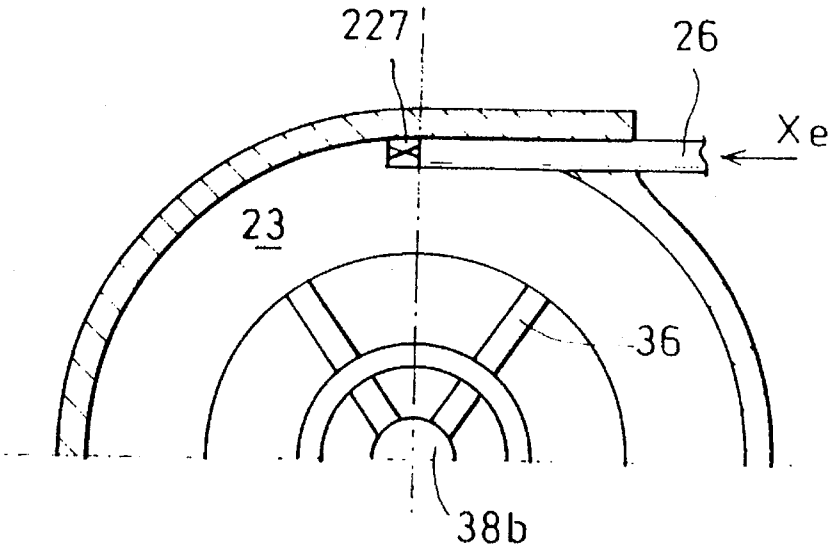
FIG. 11 is a half-section view along plane XI—XI of FIG. 10.
Figure 10:
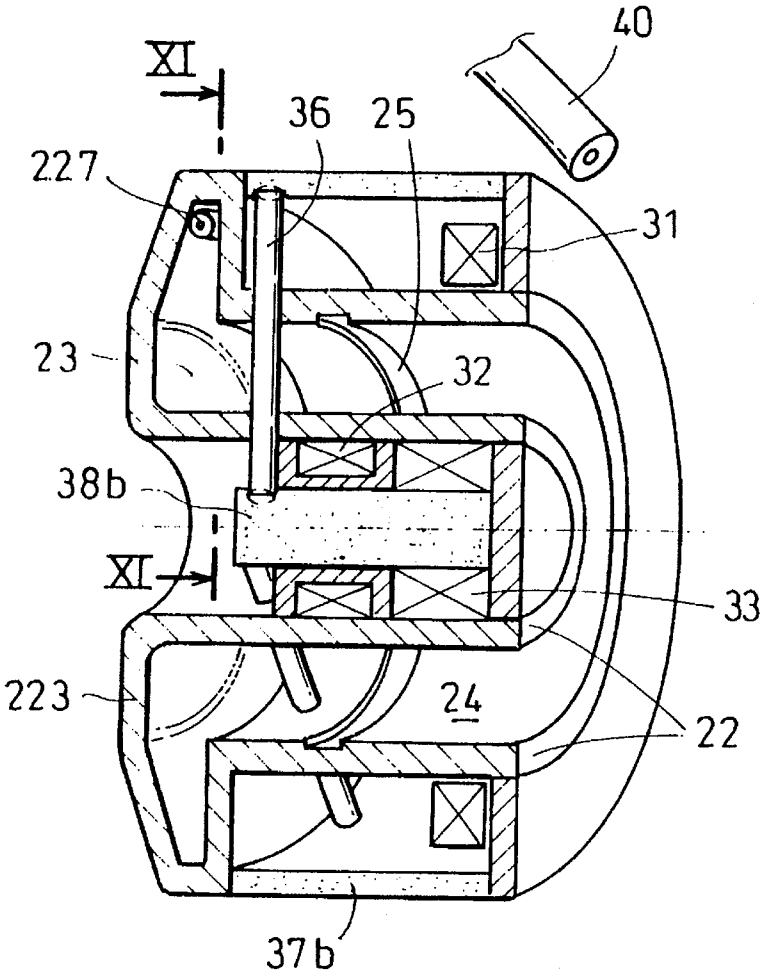
FIG. 10 is an axial section through a particular embodiment of a plasma accelerator of the invention comprising a buffer chamber which has a reduced length and is associated with a tangential gas injector.

FIGS. 10 and 11 show a plasma accelerator according to the invention in which the buffer chamber 23 in the longitudinal direction has a reduced length, which may even be slightly smaller than the transversal dimension of the acceleration channel 24.

In this case, the annular manifold 27 is replaced by a tangential gas injector 227 which comprises a sonic throat enabling a tangential input of gas into the buffer chamber 23 with a vortex effect which permits a homogenization of the gas flow notwithstanding the small longitudinal dimension of the buffer chamber 23. The other parts of the accelerator of FIGS. 10 and 11 may be constituted for example according to the embodiment of FIG. 6 and will not be described again.

Figure 12:
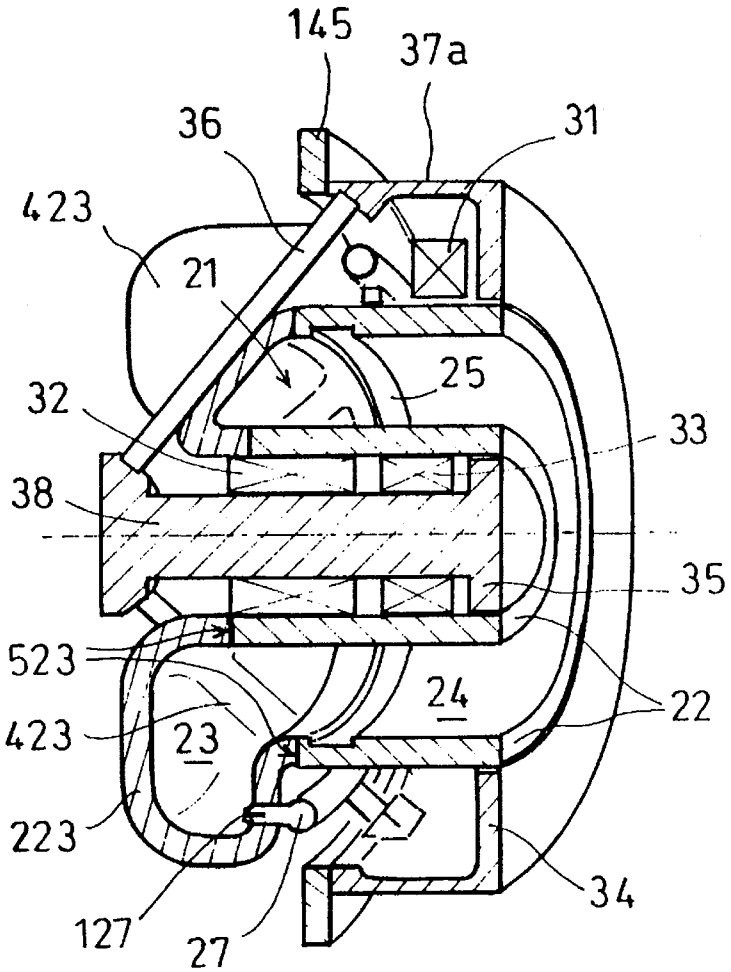
FIG. 12 is an axial section through a particular embodiment of a plasma accelerator of the invention, comprising a buffer chamber divided into a plurality of alveoles between which are located magnetic bars.
Figure 13:
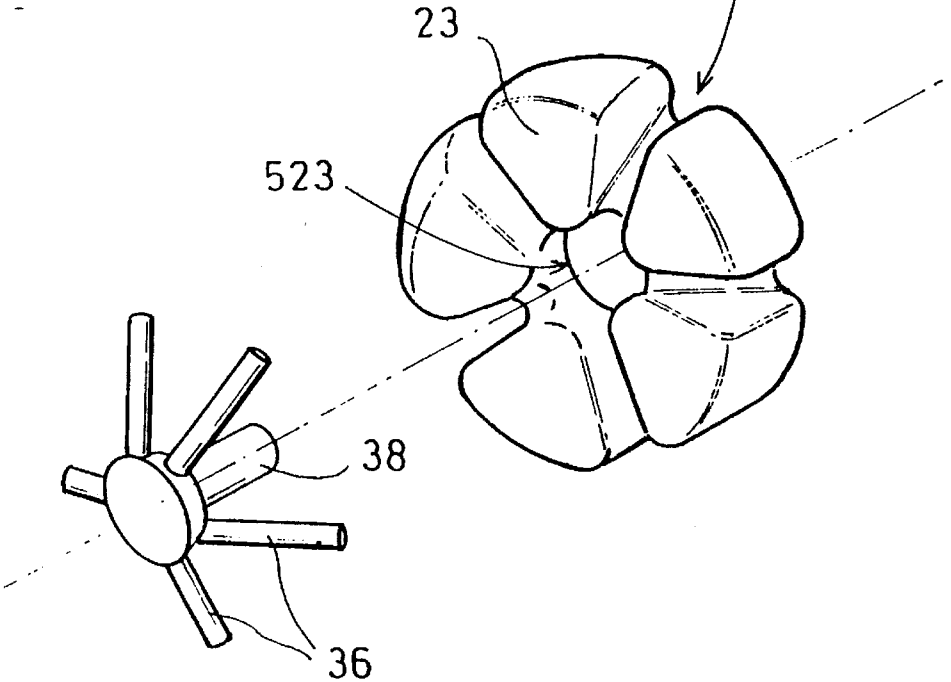
FIG. 13 is a perspective exploded view showing a buffer chamber made in one piece and a set of magnetic bars which may be incorporated in the plasma accelerator of FIG. 12.

FIG. 12 shows a particular embodiment of a plasma accelerator according to the invention, in which the buffer chamber 23, which is shown as a perspective view on FIG. 13, comprises a plurality of alveoles which open out into the acceleration channel 24 in the vicinity of the anode 25, are distributed around the axis of the accelerator and are delimited by partitions which are parallel to the axis of the accelerator. The partitions which are essentially parallel to the axis of the motor define, between adjacent alveoles, passages 423 for magnetic bars 36 which constitute the yoke. In this case, the magnetic bars 36 do not physically penetrate into the buffer chamber 23 which may be made in one piece and may be fabricated for example by techniques of glass or quartz blowing. The buffer chamber 23, which is to some extent moulded around the bars, may be made in a mould rather than by a blowing technique. The walls 223 of the alveolate buffer chamber 23 are made in a material which is different from the material of the cylindrical portion 22 of the acceleration channel 24. The junction between the downstream end of the walls 223 of the alveolate buffer chamber 23 and the upstream end of the walls 22 of the annular channel 21 bearing the anode 25 bears the reference 523.

The annular manifold 27 may be mounted in advance on the wall of the buffer chamber 23. The annular manifold 27 is associated with sonic throats 127 which open out in the different alveoles of the alveolate buffer chamber 23. As can be seen on FIG. 12, the injection may advantageously be made towards the upstream end, the annular manifold 27 being itself located downstream from the buffer chamber 23. The injection proper of ionizable gas is always made at a certain distance upstream from the anode 25.

The buffer chamber 23 may comprise for example from three to nine alveoles, the magnetic bars 36 being located within the passages 423, and the number of magnetic bars being equal to the number of alveoles.

The set comprising the magnetic circuit constituted by parts 36, 38, 35 and coils 32 and 33 may be introduced through the rear part of the buffer chamber 23.

Figure 14:
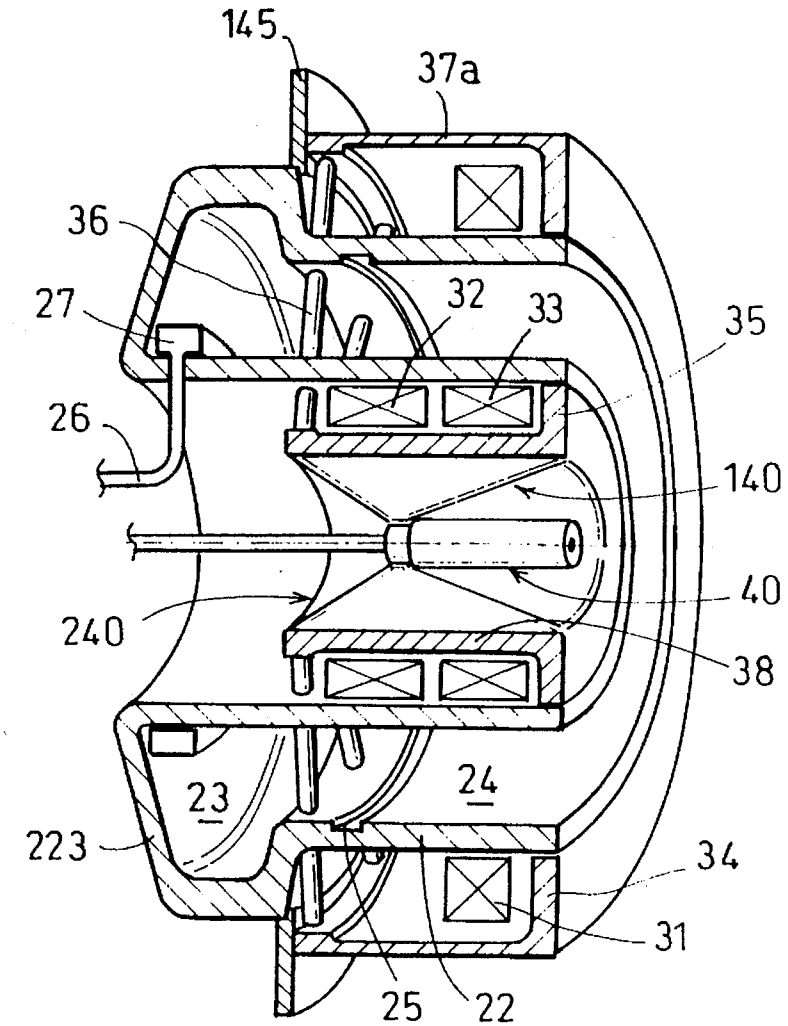
FIG. 14 is an axial reaction through a particular embodiment of a plasma accelerator of the invention which has a mean diameter larger than the width of the acceleration channel, and comprises a hollow cathode which is located within a central polar piece shaped in a hollow tube.

FIG. 14 shows a particular embodiment of the invention which may be applied to a plasma accelerator whose acceleration channel 24 has a mean diameter which is important with respect to the channel width. In this case, the central polar piece 38 may be tubular in shape, a central free space being reserved for inserting the hollow cathode 40 which is then located along the axis of the motor. To avoid that the coils 32, 33 be overheated by the cathode 40, a super insulating screen 140, which may for example be conical in shape and open at the downstream end, is located around the cathode 40 to authorize an expansion of the beam of the cathode 40 only towards the free space. The cathode 40 is kept in a definite position with respect to the tubular central polar piece 38 by means of a mechanical support 240.

FIGS. 12 and 14 show the interface flange 145 which is located near the link between the bars 36 and the outer shell 37*a* and serves for mounting the accelerator on a satellite.

In all of the embodiments described, the fact that the magnetic circuit does not go to the end of the accelerator upstream from the buffer chamber 23 makes it possible to reduce the total length and mass of the accelerator, without impeding operation thereof.

What we claim is:

1. A plasma accelerator of short length with closed electron drift, comprising a main annular channel for ionization and acceleration (24) delimited by parts (22) of insulating material and open at its downstream end (225), at least one hollow cathode (40) disposed outside the main annular channel (24) adjacent to the downstream portion thereof, an annular anode (25) concentric with the main annular channel (24) and disposed at a distance from the open downstream end (225) thereof, first and second means (41, 26) for feeding ionizable gas and respectively associated with the hollow cathode (40) and with the annular anode (25), magnetic means (31 to 33, 34 to 38) for creating a magnetic field in the main annular channel (24), and an annular buffer chamber (23) whose size in the radial direction is at least equal to that of the main annular channel (24) and which extends upstream therefrom beyond the zone in which the annular anode (25) is placed, the second means (26) for feeding an ionizable gas opening out in the annular buffer chamber (23) upstream from the anode (25) into a zone that is distinct from the zone including the anode (25), characterized in that the means (31 to 33, 34 to 38) for creating a magnetic field in the main channel (24) are adapted to produce a magnetic field in said main channel (24) that is essentially radial at the downstream end (225) of the channel (24) and has a maximum induction at this level, this magnetic field having a minimum induction in the transition zone situated in the vicinity of the anode (25), the absolute value of the induction of this magnetic field increasing again upstream from the anode (25), at the level of the buffer chamber (23) to produce a magnetic mirror effect, the magnetic field having, between the anode (25) and the downstream end (225) of the channel 24), a concavity which is orientated downwards and produces a focussing of the ions, a region located downstream from the anode (25) having a maximum ionisation density, in that the means for creating a magnetic field comprise a plurality of distinct magnetic field creation means (31 to 33) and inner and outer plane radial pole pieces (35, 34) disposed level with the outlet face on either side of the main channel (24) and interconnected by a central core (38), a yoke (36), and a peripheral magnetic circuit (37) disposed axially outside the main channel (24), the yoke (36) being made up of radial elements situated in the immediate vicinity of the anode (25) and penetrating into the annular buffer chamber (23), communication spaces (13) between the annular buffer chamber (23) and the main channel (24) being left between the radial elements.

2. A plasma accelerator according to claim 1, characterized in that the dimension of the buffer chamber (23) in the radial direction is comprised between once and twice the radial dimension of the main channel (24).

3. A plasma accelerator according to claim 1, characterized in that the distinct magnetic field creation means (31 to 33) comprise first means (31) disposed around and outside the main channel (24) in the vicinity of the downstream end (225) thereof, second means (32) disposed around the central core (38) in a zone facing the anode (25) and extending in part over the buffer chamber (23) for the creation of the magnetic mirror effect, and third means (33) disposed around the central core (38) between the second means (32) and the downstream end (225) of the main channel (24).

4. A plasma accelerator according to claim 3, characterized in that the first, second, and third magnetic field creation means (31, 32, 33) are constituted by induction coils.

5. A plasma accelerator according to claim 1, characterized in that the buffer chamber (23) comprises a plurality of alveoli which open out into the acceleration channel (24) in the vicinity of the anode (25), are distributed around the axis of the accelerator and are delimited by partitions which are parallel to the axis of the accelerator and define, between adjacent alveoli, passages (423) for cylindrical magnetic bars which constitute the yoke (36) without penetrating into the alveolate buffer chamber (23).

6. A plasma accelerator according to claim 5, characterized in that the alveolate buffer chamber (23) is made in one piece.

7. A plasma accelerator according to of claim 1, characterized in that the yoke (36) includes radial elements constituted by cylindrical magnetic bars passing through the annular chamber (23).

8. A plasma accelerator according to claim 7, characterized in that the magnetic bars (36) are constituted by metal bars that are electrically insulated by two-part sheaths (141, 142) which parts are respectively secured to the walls (22) of the main channel (24) and to the walls (224) of the buffer chamber (23).

9. A plasma accelerator according to claim 7, characterized in that the magnetic bars (36) are interconnected at their peripherally outer ends by a continuous magnetic ring (36A) constituting a structural part for fixing the accelerator to the structure of a satellite.

10. A plasma accelerator according to claim 7, characterized in that the magnetic bars (36) are constituted by metal bars that are electrically insulated from ground by ferrite parts (37*b*, 38*b*) respectively constituting said central core (38) and said peripheral magnetic circuit (37) disposed axially outside the main channel (24), the magnetic bars (36) being capable of being biased to the same potential as the anode (25).

11. A plasma accelerator according to claim 7, characterized in that the magnetic bars (36) are constituted by an insulating ferrite material enabling them to be directly implanted in the buffer chamber (23).

12. A plasma accelerator according to claim 7, characterized in that the peripheral magnetic circuit (37) comprises a set of link bars between the radially outer pole piece (34) and the yoke (36).

13. A plasma accelerator according to claim 1, characterized in that the peripheral magnetic circuit (37) is constituted by a shell.

14. A plasma accelerator according to any one of claim 1, characterized in that the yoke (36) comprises bars extending radially in a plane substantially perpendicular to the axis of the buffer chamber (23) and of the main channel (24).

15. A plasma accelerator according to claim 1, characterized in that the yoke (36) comprises bars extending radially along the generator lines of a truncated cone whose small section end is connected to the central core (38), its larger section end being connected to the peripheral magnetic circuit (37), and its axis coinciding substantially with the axis of the buffer chamber (23) and of the main channel (24).

16. A plasma accelerator according to claims 1, characterized in that the yoke (36) comprises a frustoconical ferrite part whose smaller section end is connected to the central core (38) and whose larger section end is connected to a shell (37*a*) constituting the peripheral magnetic circuit (37), channels (136) formed axially through said frustoconical part constituting said spaces for communication between the annual buffer chamber (23) and the main channel (24).

17. A plasma accelerator according to claim 1, characterized in that the second means (26) for feeding an ionizable gas open out in the annular buffer chamber (23) upstream from the anode (25) through an annular manifold (27).

18. A plasma accelerator according to claim 5 and claim 17, characterized in that the annular manifold (27) is associated with sonic throats (127) opening out in the different alveoles of the alveolate buffer chamber (23).

19. A plasma accelerator according to claim 1, characterized in that the second means (26) for feeding an ionizable gas open out in the annual buffer chamber (23) upstream from the anode (25) through a single sonic throat (227) which is mounted tangentially along the largest diameter of the buffer chamber to create a vortex.

20. A plasma accelerator according to claim 1, characterized in that the hollow cathode (40) is located along the axis of the accelerator within the central tubular core (38) and is thermally insulated from this central core (38) through a superinsulating screen (140).

* * * * *